US011618056B2

(12) United States Patent
Liu et al.

(10) Patent No.: US 11,618,056 B2
(45) Date of Patent: Apr. 4, 2023

(54) CAPACITIVE MICROMACHINED ULTRASONIC TRANSDUCER, METHOD FOR PREPARING THE SAME, PANEL, AND DEVICE

(71) Applicant: BOE TECHNOLOGY GROUP CO., LTD., Beijing (CN)

(72) Inventors: Xiaotong Liu, Beijing (CN); Yongchun Tao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 256 days.

(21) Appl. No.: 16/967,071

(22) PCT Filed: Oct. 25, 2019

(86) PCT No.: PCT/CN2019/113156
§ 371 (c)(1),
(2) Date: Aug. 3, 2020

(87) PCT Pub. No.: WO2021/077381
PCT Pub. Date: Apr. 29, 2021

(65) Prior Publication Data

US 2021/0138507 A1 May 13, 2021

(51) Int. Cl.
*B06B 1/02* (2006.01)

(52) U.S. Cl.
CPC ..... *B06B 1/0292* (2013.01)

(58) Field of Classification Search
CPC . B06B 1/0269; B06B 1/0292; B06B 2201/76; B06B 81/0603; B06B 1/0622;
(Continued)

(56) References Cited

U.S. PATENT DOCUMENTS

2005/0146240 A1* 7/2005 Smith ..... B06B 1/0292 310/309
2005/0169107 A1* 8/2005 Thomenius ..... H03M 11/00 367/105

(Continued)

FOREIGN PATENT DOCUMENTS

CN 101772383 A 7/2010
CN 101873830 A 10/2010

(Continued)

*Primary Examiner* — Daniel L Murphy
*Assistant Examiner* — Amie M Ndure
(74) *Attorney, Agent, or Firm* — Muncy, Geissler, Olds & Lowe, P.C.

(57) ABSTRACT

The present disclosure provides a capacitive micro-machined ultrasonic transducer, a method for preparing the same, a panel, and a device, and belongs to the technical field of ultrasonic imaging. A capacitive micro-machined ultrasonic transducer includes a first electrode, a vibrating diaphragm layer and a second electrode that are arranged in order from bottom to top, a cavity existing between the first electrode and the vibrating diaphragm layer, in which the capacitive micro-machined ultrasonic transducer further includes a third electrode located on a surface of the vibrating diaphragm layer proximate to the cavity, an orthogonal projection of the third electrode on the first electrode covers a part of an orthogonal projection of the cavity on the first electrode. The technical solution of the present disclosure can realize the conversion of the frequency of the ultrasonic waves emitted by the capacitive micro-machined ultrasonic transducer.

19 Claims, 7 Drawing Sheets

(58) Field of Classification Search
CPC ..... H01L 41/047; H01L 41/0973; H01L 41/1138; H01L 41/27; H01L 41/316
See application file for complete search history.

(56) References Cited

U.S. PATENT DOCUMENTS

| | | | | |
|---|---|---|---|---|
| 2006/0004289 | A1* | 1/2006 | Tian | B06B 1/0292 600/459 |
| 2007/0083119 | A1* | 4/2007 | Adachi | A61B 8/00 600/437 |
| 2007/0287918 | A1* | 12/2007 | Huang | B06B 1/0292 73/866.5 |
| 2008/0232615 | A1* | 9/2008 | Song | H04R 19/005 381/174 |
| 2010/0202254 | A1 | 8/2010 | Roest et al. | |
| 2010/0254222 | A1* | 10/2010 | Huang | B06B 1/0292 367/181 |
| 2015/0032002 | A1* | 1/2015 | Rothberg | B06B 1/0292 600/440 |
| 2016/0310992 | A1 | 10/2016 | Van Rens et al. | |
| 2017/0368574 | A1* | 12/2017 | Sammoura | H01L 41/332 |

FOREIGN PATENT DOCUMENTS

| | | | | |
|---|---|---|---|---|
| CN | 104907241 | A | 9/2015 | |
| CN | 105828962 | A | 8/2016 | |
| CN | 109530194 | A | 3/2019 | |
| CN | 110008929 | A * | 7/2019 | G06K 9/0002 |
| WO | WO-2018/10015 | A1 | 6/2018 | |

* cited by examiner

CAPACITIVE MICROMACHINED ULTRASONIC TRANSDUCER, METHOD FOR PREPARING THE SAME, PANEL, AND DEVICE

CROSS-REFERENCE TO RELATED APPLICATION

This application is the U.S. national phase of PCT Application No. PCT/CN2019/113156 filed on Oct. 25, 2019, the disclosures of which is incorporated in their entirety by reference herein.

TECHNICAL FIELD

The present disclosure relates to the field of ultrasonic imaging technology, in particular, to a capacitive micromachined ultrasonic transducer, a method for preparing the same, a panel, and a device.

BACKGROUND

In the related art, the capacitive micro-machined ultrasonic transducer (CMUT) in the ultrasonic probe only supports detection in one frequency range, and only performs ultrasound imaging on one body part.

SUMMARY

The technical problem to be solved by the present disclosure is to provide a capacitive micro-machined ultrasonic transducer, a method for preparing the same, a panel, and a device, which can realize the conversion of the frequency of the ultrasonic waves emitted by the capacitive micro-machined ultrasonic transducer.

To solve the above technical problems, the embodiments of the present disclosure provide technical solutions as follows.

An embodiment of the present disclosure provides a capacitive micro-machined ultrasonic transducer, including a first electrode, a vibrating diaphragm layer and a second electrode that are arranged in order from bottom to top, in which a cavity existing between the first electrode and the vibrating diaphragm layer, in which the capacitive micro-machined ultrasonic transducer further includes a third electrode located on a surface of the vibrating diaphragm layer proximate to the cavity, and an orthogonal projection of the third electrode on the first electrode covers a part of an orthogonal projection of the cavity on the first electrode.

Optionally, the first electrode and the third electrode are configured such that, after electrical signals of different polarities are applied, the third electrode moves to the first electrode under the action of an electric field so that a thickness of a portion of the cavity corresponding to the third electrode in a direction perpendicular to the first electrode is 0.

Optionally, an orthogonal projection of the cavity on the first electrode covers an orthogonal projection of the third electrode on the first electrode, and the third electrode includes at least one hollowed-out area.

Optionally, an orthogonal projection of the cavity on the first electrode is a first circle, an orthogonal projection of the hollowed-out area on the first electrode is a second circle, and a diameter of the second circle is smaller than a diameter of the first circle.

Optionally, the third electrode includes two or three or four hollowed-out areas.

Optionally, it also includes a signal line connected to the third electrode.

Optionally, a lower surface of the third electrode proximate to the first electrode is substantially flush with a lower surface of the vibrating diaphragm layer proximate to the first electrode.

Optionally, the vibrating diaphragm layer is provided with a via hole communicating with the cavity, the capacitive micro-machined ultrasonic transducer further includes a filling structure, a part of the filling structure fills the via hole, and the other part of the filling structure is located in the cavity.

Optionally, a diameter of the via hole is in a range from 1 μm to 10 μm.

Optionally, the vibrating diaphragm layer includes a first portion corresponding to the cavity and a support portion other than the first portion, and an orthogonal projection of the first portion on the first electrode coincides with an orthogonal projection of the cavity on the first electrode.

Optionally, a thickness of the cavity in a direction perpendicular to the first electrode is in a range from 1 nm to 10 μm.

Optionally, it also includes an insulating layer on a surface of the second electrode away from the first electrode.

Optionally, a material of the third electrode is the same as a material of the second electrode; and/or a material of the third electrode is the same as a material of the first electrode.

An embodiment of the present disclosure provides a capacitive micro-machined ultrasonic transducing panel, including a plurality of the above capacitive micro-machined ultrasonic transducers that are arranged in an array.

An embodiment of the present disclosure provides a capacitive micro-machined ultrasonic transducing device, including the above capacitive micro-machined ultrasonic transducing panel and a driving circuit, in which the driving circuit is connected to the first electrode and the third electrode of the capacitive micro-machined ultrasonic transducer, and configured to apply electrical signals of different polarities to the first electrode and the third electrode.

The embodiments of the present disclosure provide a method for preparing a capacitive micro-machined ultrasonic transducer, including forming a first electrode, a vibrating diaphragm layer, and a second electrode that are arranged in order from bottom to top, in which a cavity exists between the first electrode and the vibrating diaphragm layer; and the method further includes forming a third electrode located on a surface of the vibrating diaphragm layer proximate to the cavity, in which an orthogonal projection of the third electrode on the first electrode covers a part of an orthogonal projection of the cavity on the first electrode.

Optionally, the method also includes forming a signal line connected to the third electrode.

Optionally, the signal line and the third electrode are formed by a signal patterning process.

Optionally, the vibrating diaphragm layer is provided with a via hole communicating with the cavity, and the method further includes forming a filling structure, in which a part of the filling structure fills the via hole, and the other part of the filling structure is located in the cavity.

Optionally, the forming the cavity includes: forming a sacrificial layer on the first electrode; forming a third electrode on the sacrificial layer; forming a vibrating diaphragm layer covering the third electrode and the sacrificial layer, in which the vibrating diaphragm layer has a via hole exposing the sacrificial layer; and removing the sacrificial layer through the via hole, to form the cavity between the vibrating diaphragm layer and the first electrode.

REFERENCE NUMBERS

1 first electrode; 2 cavity; 3 third electrode; 4 vibrating diaphragm layer; 5 filling structure; 6 insulating layer; 7 second electrode; 8 hollowed-out area; 9 sacrifice layer; 10 via hole; 21 sub-cavity; 31 signal line; 41 first portion; 42 second portion; 43 supporting portion.

DETAILED DESCRIPTION

In order to make the technical problems to be solved, the technical solutions, and the advantages of the examples of the present disclosure, the present disclosure will be described hereinafter in conjunction with the drawings and specific examples.

In the related art, the capacitive micro-machined ultrasonic transducer in the ultrasonic probe only supports detection in one frequency range, and only performs ultrasound imaging on one body part. Generally, when the ultrasonic frequency emitted by the CMUT is in a range from 2.5 MHz to 5 MHz, it is used for abdominal and cardiac examination; when the ultrasonic frequency emitted by the CMUT is in a range from 5 MHz to 10 MHz, it is used for small organs and eye examinations; when the ultrasonic frequency emitted by the CMUT is in a range from 10 MHz to 30 MHz, it is used for skin and intravascular examinations; and when the ultrasonic frequency emitted by the CMUT is in a range from 40 MHz to 100 MHz, it is used for biological microscope imaging.

Figure 1:
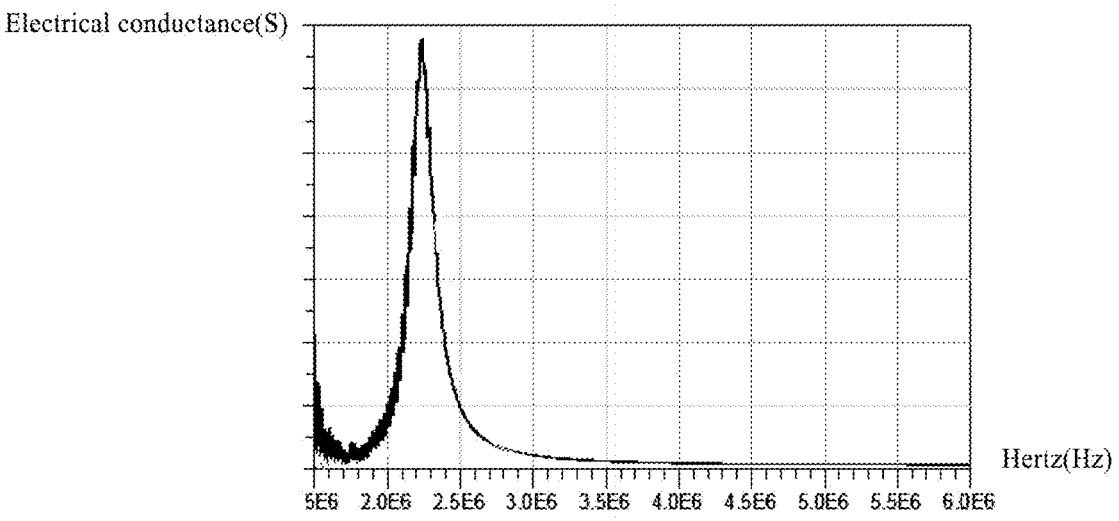
FIG. 1 is a schematic view showing the vibrating diaphragm layer of a capacitive micro-machined ultrasonic transducer having an effective radius of 24 μm and a resonance frequency of 2.2 MHz.
Figure 2:
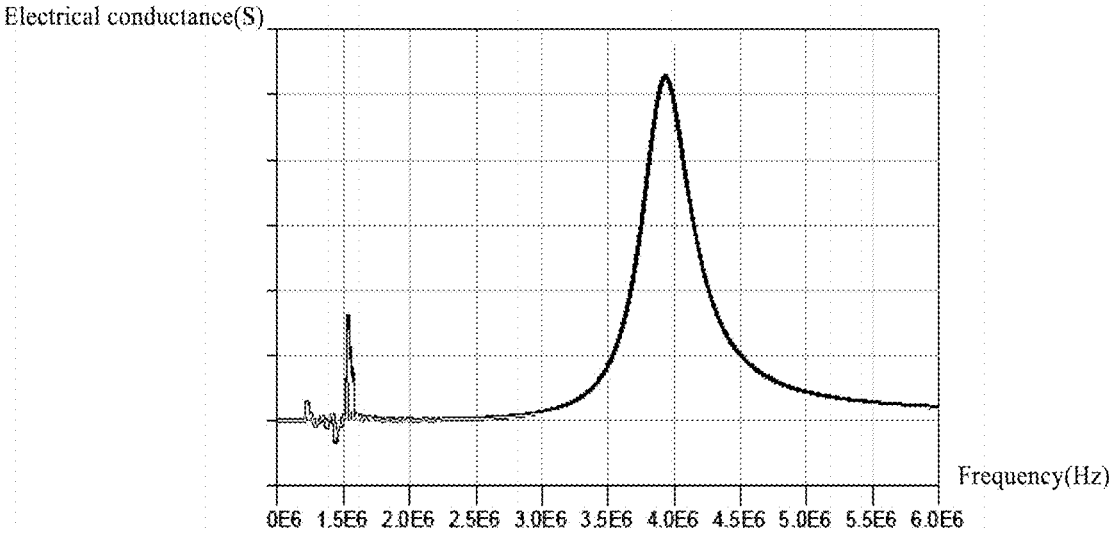
FIG. 2 is a schematic view showing the vibrating diaphragm layer of a capacitive micro-machined ultrasonic transducer having an effective radius of 20 μm and a resonance frequency of 3.9 MHz.
Figure 3:
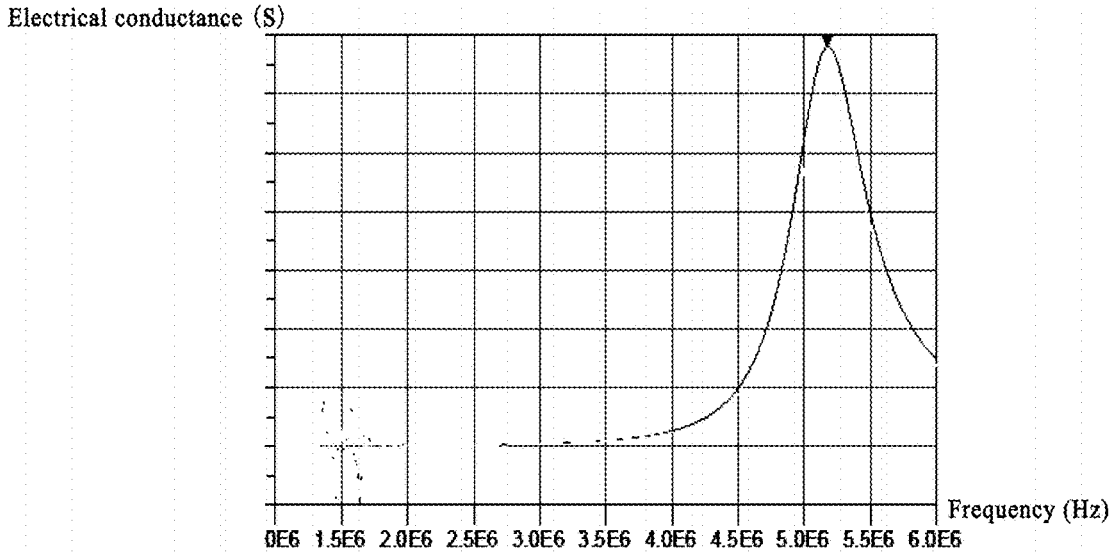
FIG. 3 is a schematic view showing the vibrating diaphragm layer of a capacitive micro-machined ultrasonic transducer having an effective radius of 18 μm and a resonance frequency of 5.2 MHz.
Figure 4:
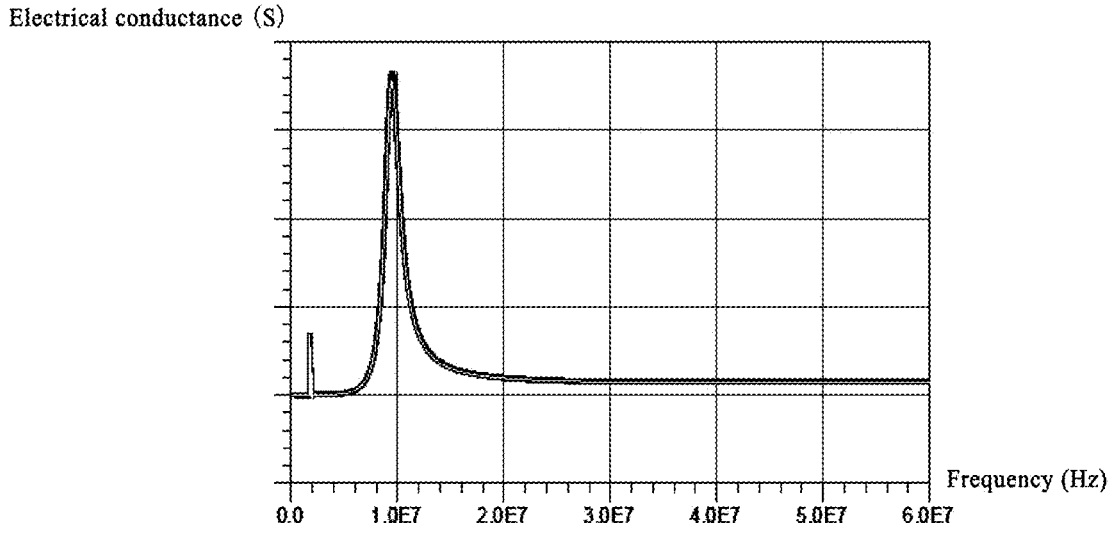
FIG. 4 is a schematic view showing the vibrating diaphragm layer of a capacitive micro-machined ultrasonic transducer having an effective radius of 14 μm and a resonance frequency of 9.5 MHz.
Figure 5:
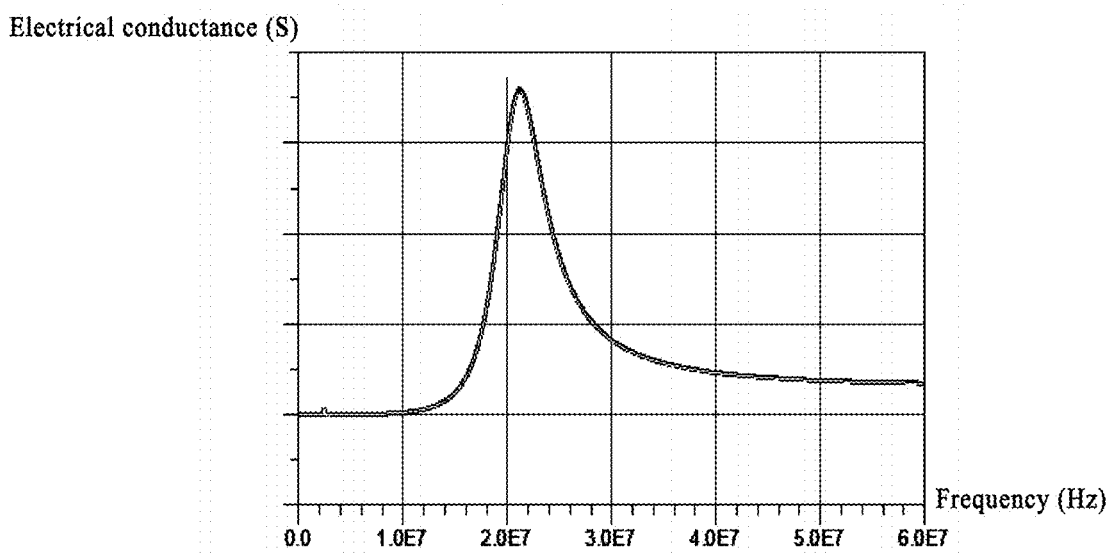
FIG. 5 is a schematic view showing the vibrating diaphragm layer of a capacitive micro-machined ultrasonic transducer having an effective radius of 10 μm and a resonance frequency of 21 MHz.

The inventor of the present disclosure finds that the effective radius and/or effective area of the vibrating diaphragm layer of the capacitive micro-machined ultrasonic transducer determines the resonance frequency of the capacitive micro-machined ultrasonic transducer. As shown in FIG. 1, it is found that when the effective radius of the vibrating diaphragm layer of the capacitive micro-machined ultrasonic transducer is 24 μ, the resonance frequency of the capacitive micro-machined ultrasonic transducer is 2.2 MHz. As shown in FIG. 2, after simulation, it is found that when the effective radius of the vibrating diaphragm layer is 20 μm, the resonance frequency of the capacitive micro-machined ultrasonic transducer is 3.9 MHz. As shown in FIG. 3, after simulation, it is found that when the effective radius of the vibrating diaphragm layer is 18 μm, the resonance frequency of the capacitive micro-machined ultrasonic transducer is 5.2 MHz. As shown in FIG. 4, after simulation, it is found that when the effective radius of the vibrating diaphragm layer is 14 μm, the resonance frequency of the capacitive micro-machined ultrasonic transducer is 9.5 MHz. As shown in FIG. 5, after simulation, it is found that when the effective radius of the vibrating diaphragm layer is 10 μm, the resonance frequency of the capacitive micro-machined ultrasonic transducer is 21 MHz. Among them, the effective radius of the vibrating diaphragm layer of the capacitive micro-machined ultrasonic transducer is the radius of the portion where the vibrating diaphragm layer can vibrate, and the effective area of the vibrating diaphragm layer of the capacitive micro-machined ultrasonic transducer is areas of the portion where the vibrating diaphragm layer can vibrate.

Therefore, an embodiments of the present disclosure provide a capacitive micro-machined ultrasonic transducer, a method for preparing the same, a panel, and a device, which can realize the conversion of the frequency of the ultrasonic waves emitted by the capacitive micro-machined ultrasonic transducer by changing the effective area and/or effective radius of the vibrating diaphragm layer of the capacitive micro-machined ultrasonic transducer.

Figure 6:
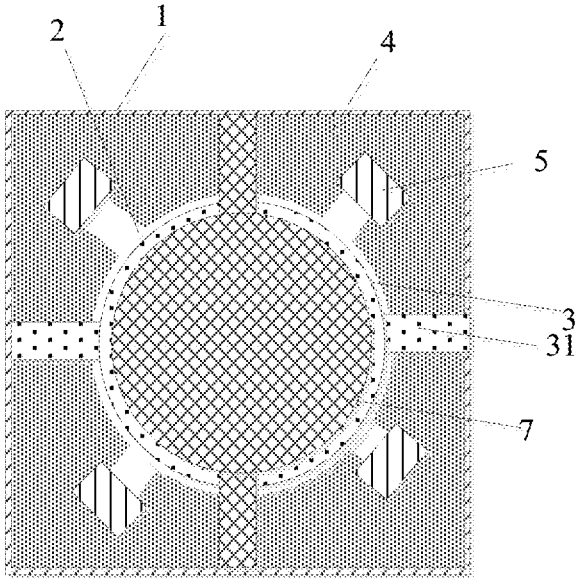
FIG. 6 is a schematic top view showing the capacitive micro-machined ultrasonic transducer according to an embodiment of the present disclosure.

An embodiment of the present disclosure provides a capacitive micro-machined ultrasonic transducer. FIG. 6 is a schematic top view showing the capacitive micro-machined ultrasonic transducer according to an embodiment of the present disclosure. FIG. 8, FIG. 9, FIG. 11, FIG. 12, FIG. 14 and FIG. 15 are schematic views showing the cross section of the capacitive micro-machined ultrasonic transducer according to a specific embodiment of the present disclosure. As shown in FIG. 8, FIG. 9, FIG. 11, FIG. 12, FIG. 14, and FIG. 15, the capacitive micro-machined ultrasonic transducer according to embodiment of the present disclosure includes a first electrode 1, a vibrating diaphragm layer 4 and a second electrode 7 that are arranged in order from bottom to top, and a cavity 2 exists between the first electrode 1 and the vibrating diaphragm layer 4, in which the capacitive micro-machined ultrasonic transducer further includes a third electrode 3 located on a surface of the vibrating diaphragm layer 4 proximate to the cavity 2, in which an orthogonal projection of the third electrode 3 on the first electrode 1 covers a part of an orthogonal projection of the cavity 2 on the first electrode 1.

Among them, the first electrode 1 and the third electrode 3 are configured such that, after electrical signals of different polarities are applied, the third electrode 3 moves to the first electrode 1 under the action of an electric field so that a thickness of a portion of the cavity 2 corresponding to the third electrode 3 in a direction perpendicular to the first electrode 1 is 0. Thus, the effective area of the cavity 2 can be changed, in which an orthogonal projection of the portion of the cavity 2 corresponding to the third electrode 3 on one electrode 1 coincides with an orthogonal projection of the third electrode 3 on the first electrode 1.

When there is no film layer other than the cavity 2 between the third electrode 3 and the first electrode 1, under the action of the electric field, the third electrode 3 will be in contact with the first electrode 1; and when an insulating layer is further arranged on a surface of the first electrode 1 proximate to the cavity 2, under the action of the electric field, the third electrode 3 will be in contact with the insulating layer.

Figure 8:
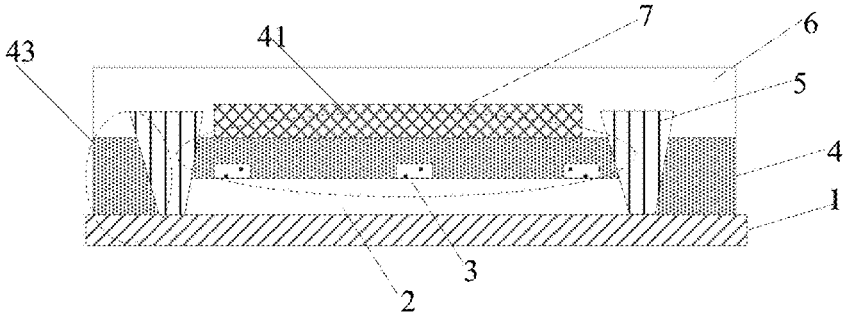
FIGS. 8 and 9 are schematic view showing the cross section of the capacitive micro-machined ultrasonic transducer in the direction of A-A in FIG. 7.
Figure 9:
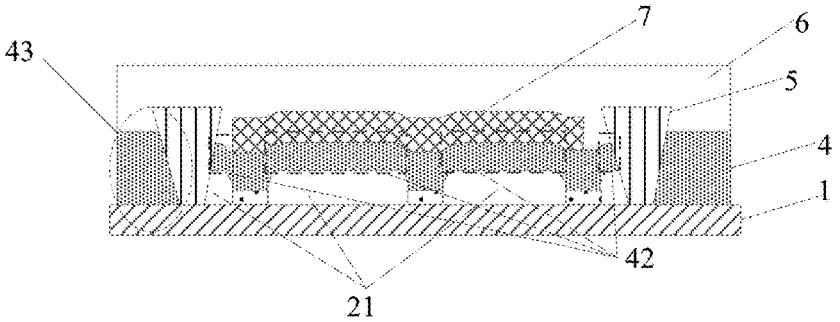
Figure 11:
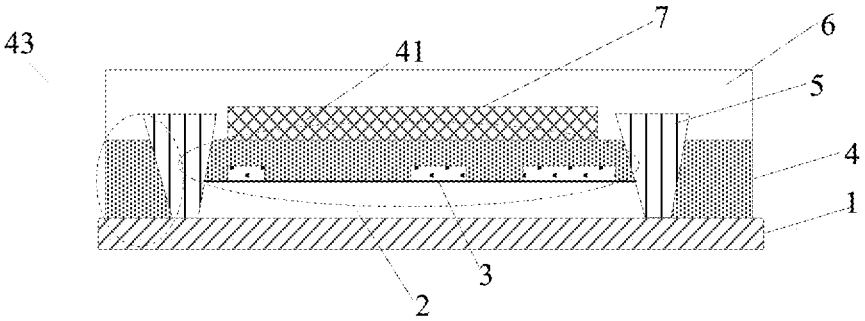
FIGS. 11 and 12 are schematic view showing the cross section of the capacitive micro-machined ultrasonic transducer in the direction of B-B in FIG. 10.
Figure 12:
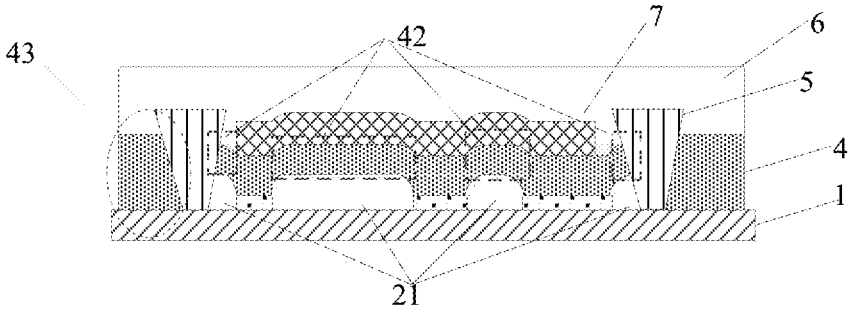
Figure 14:
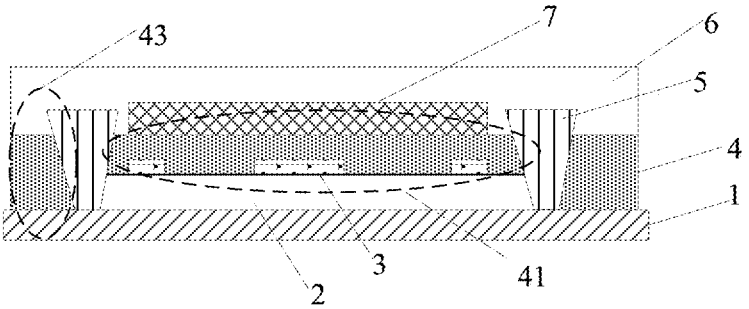
FIGS. 14 and 15 are schematic view showing the cross section of the capacitive micro-machined ultrasonic transducer in the direction of C-C in FIG. 13.
Figure 15:
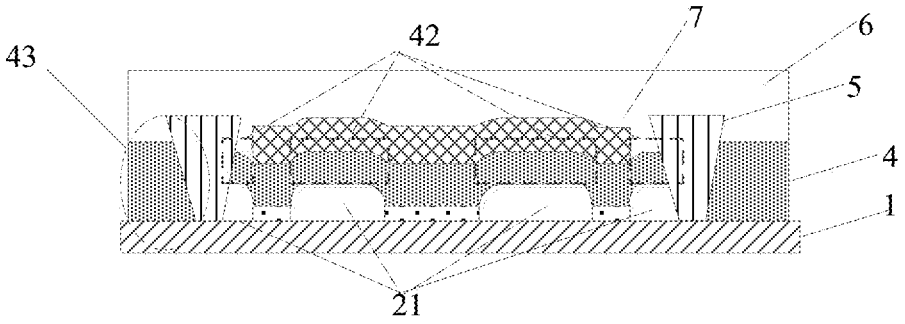

Taking as an example that there is no film layer other than the cavity 2 between the third electrode 3 and the first electrode 1, in this embodiment, the third electrode 3 is arranged on the surface of the vibrating diaphragm layer 4 proximate to the cavity 2, and a lower surface of the third electrode 3 proximate to the first electrode 1 is substantially flush with a lower surface of the vibrating diaphragm layer 4 proximate to the first electrode 1. The expression of "substantially flush" means that a maximum distance between the lower surface of the third electrode 3 proximate to the first electrode 1 and the lower surface of the vibrating diaphragm 4 proximate to the first electrode 1 in the direction perpendicular to the first electrode 1 is not greater than a preset threshold. Specifically, the preset threshold may be 1 μm. When no electrical signal is passed to the third electrode 3, a cavity 2 is formed between the vibrating diaphragm layer 4 and the first electrode 1, in which the area of the cavity 2 is shown in FIGS. 8, 11, and 14. The vibrating diaphragm layer 4 includes a first portion 41 corresponding to the cavity 2 and a supporting portion 43 other than the first portion 41. The supporting portion 43 surrounds the cavity 2. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasound transducer is the first frequency. After electrical signals of opposite polarities are input to the third electrode 3 and the first electrode 1, as shown in FIGS. 9, 12, and 15, the third electrode 3 contacts the first electrode 1 and drives the vibrating diaphragm layer 4 proximate to the first electrode 1 under the action of the electric field. The cavity 2 is separated by the vibrating diaphragm layer 4 into a plurality of small sub-cavities 21, and the second portion 42 of the vibrating diaphragm layer 4 corresponding to the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

Among them, the area of the second portion 42 is determined by the shape and size of the third electrode 3. By changing the shape and size of the third electrode 3, the area of the second portion 42 can be changed, thereby adjusting the resonance frequency of the capacitive micro-machined ultrasound transducer.

For example, by changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 5 MHz to 10 MHz, so that the application of the ultrasound probe of the CMUT panel can be used for abdominal and cardiac examinations, as well as small organs and eye examinations. By changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 10 MHz to 30 MHz, so that the application of the ultrasound probe of the CMUT panel can be used for abdominal and cardiac examinations, as well as skin and intravascular examinations. By changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 40 MHz to 100 MHz, so that the application of the ultrasound probe of the CMUT panel can be used for abdominal and cardiac examinations, as well as biological microscope imaging. By changing the shape and size of the third electrode 3, and then by controlling whether electrical signals are input to the third electrode 3 or not, the resonance frequency of the capacitive micro-machined ultrasonic transducer can be switched between a range from 10 MHz to 30 MHz and a range from 5 MHz to 10 MHz, so that the application of the ultrasound probe of the CMUT panel can be used for skin and intravascular examinations, as well as small organs and eye examinations. By changing the shape and size of the third electrode 3, and then by controlling whether electrical signals are input to the third electrode 3 or not, the resonance frequency of the capacitive micro-machined ultrasonic transducer can be switched between a range from 40 MHz to 100 MHz and a range from 5 MHz to 10 MHz, so that the application of the ultrasound probe of the CMUT panel can be used for biological microscope imaging, as well as small organs and eye examinations. By changing the shape and size of the third electrode 3, and then by controlling whether electrical signals are input to the third electrode 3 or not, the resonance frequency of the capacitive micro-machined ultrasonic transducer can be switched between a range from 10 MHz to 30 MHz and a range from 40 MHz to 100 MHz, so that the application of the ultrasound probe of the CMUT panel can be used for skin and intravascular examinations, as well as biological microscope imaging.

Specifically, as shown in FIG. 6, the third electrode 3 is electrically connected to the electrical signal output terminal through the signal line 31, and the electrical signal can be transmitted to the third electrode 3 through the signal line 31. The signal line 31 and the third electrode 3 can be made of the same material and formed by the same patterning process.

In this embodiment, the capacitive micro-machined ultrasonic transducer is formed on a base substrate, in which the base substrate may be a quartz substrate or a glass substrate, or a silicon wafer.

The first electrode 1 may be made of a metal having better conductivity, such as Mo, Al, Au, Ti, and Ag, or a transparent conductive material, such as ITO. The second electrode 7 may also be made of a metal having better conductivity, such as Mo, Al, Au, Ti, and Ag, or a transparent conductive material, such as ITO. The third electrode 3 may also be made of a metal having better conductivity, such as Mo, Al, Au, Ti, and Ag, or a transparent conductive material, such as ITO. The materials of the first electrode 1, the second electrode 7, and the third electrode 3 may be the same or different. If the materials of the first electrode 1, the second electrode 7 and the third electrode 3 are the same, the material layers of the first electrode 1, the second electrode 7 and the third electrode 3 can be prepared by using the same film forming equipment.

The vibrating diaphragm layer 4 may be made of inorganic insulating materials, such as silicon nitride and silicon oxide. The vibrating diaphragm layer 4 is provided with a via hole communicating with the cavity 2. The via hole is used to prepare the cavity 2. In order not to affect the integrity of the cavity 2, the via hole may be located at the edge of the cavity 2. As shown in FIGS. 8, 9, 11, 12, 14 and 15, the capacitive micro-machined ultrasonic transducer includes a filling structure 5 filled in the via hole. The filling structure 5 can prevent external impurities from entering the cavity 2, so as to affect the operation of the capacitive micro-machined ultrasonic transducer. The filling structure 5 may be made of inorganic materials, such as a-Si. A part of the filling structure 5 is located in the via hole, and the other part is located in the cavity 2.

After the first electrode 1 is prepared, a sacrificial layer is prepared on the first electrode 1, and then a third electrode 3 and a vibrating diaphragm layer 4 are prepared on the sacrificial layer. The vibrating diaphragm layer 4 has a via hole. Then, the sacrificial layer is etched through the via hole, so as to remove the sacrificial layer to form the cavity 2. The larger the diameter of the via hole, the faster the speed of removing the sacrificial layer. However, the diameter of the via hole is too large, it will affect the operation of the capacitive micro-machined ultrasonic transducer. Therefore, the diameter of the via hole can be in a range from 1 μm to 10 μm, which can not only ensure the removal speed of the sacrificial layer, but also does not affect the operation of the capacitive micro-machined ultrasonic transducer.

In order to ensure the effective vibration of the vibrating diaphragm layer 4 when the capacitive micro-machined ultrasonic transducer is working, the thickness of the cavity 2 in the direction perpendicular to the first electrode 1 may be in a range from 1 nm and 10 μm, in which the thickness is the thickness of the cavity 2 when no electrical signal is applied to the first electrode and the third electrode.

Further, as shown in FIG. 8, FIG. 9, FIG. 11, FIG. 12, FIG. 14 and FIG. 15, the capacitive micro-machined ultrasonic transducer according to the embodiment of the present disclosure further includes: an insulating layer 6 located on the surface of the second electrode 7 away from the first electrode 1. The insulating layer 6 covers the second electrode 7 and the vibrating diaphragm layer 4, to protect the components of the capacitive micro-machined ultrasonic transducer. The insulating layer can be made of inorganic insulating materials, such as silicon nitride and silicon oxide.

In the capacitive micro-machined ultrasonic transducer according to the embodiment of the present disclosure, the orthogonal projection of the cavity 2 on the first electrode 1 may have any shape of square, circle, and hexagon.

Figure 7:
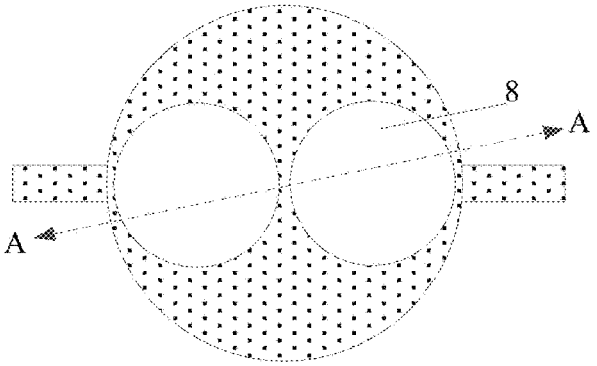
FIG. 7 is a schematic view showing the third electrode according to a specific embodiment of the present disclosure.
Figure 10:
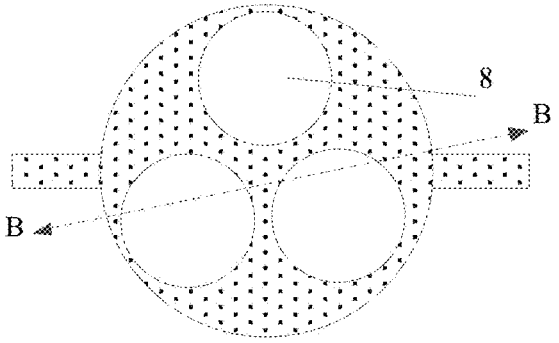
FIG. 10 is a schematic view showing the third electrode according to another specific embodiment of the present disclosure.
Figure 13:
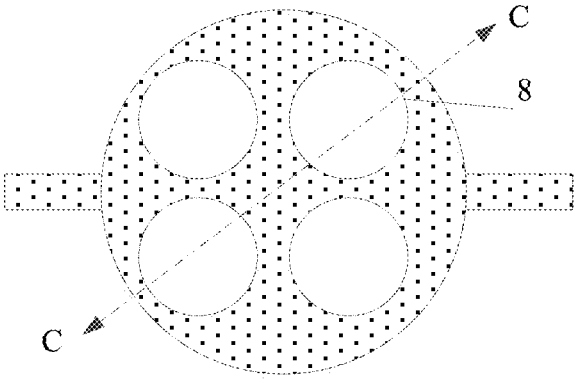
FIG. 13 is a schematic view showing the third electrode according to another specific embodiment of the present disclosure.

In a specific embodiment, the orthogonal projection of the cavity 2 on the first electrode 1 covers the orthogonal projection of the third electrode 3 on the first electrode 1, and the orthogonal projection of the cavity 2 on the first electrode 1 is a first circle. As shown in FIGS. 7, 10 and 13, the third electrode 3 includes at least one hollowed-out area 8, in which the orthogonal projection of the hollowed-out area 8 on the first electrode 1 is a second circle. The diameter of the second circle is smaller than the diameter of the first circle. After the electrical signal is input to the third electrode 3, the non-hollowed-out area of the third electrode 3 contacts the first electrode 1 and drives the vibrating diaphragm layer 4 to approach the first electrode 1 under the action of the electric field, and the portion of the vibrating diaphragm layer 4 corresponding to the hollowed-out area 8 of the third electrode 3 will not be proximate to the first electrode 1, thereby forming a plurality of sub-cavities 21.

In a specific embodiment, as shown in FIG. 6, the orthogonal projection of the cavity 2 on the first electrode 1 covers the orthogonal projection of the third electrode 3 on the first electrode 1, and an orthogonal projection of the cavity 2 on the first electrode 1 is circular. As shown in FIG. 7, the third electrode 3 includes two hollowed-out areas 8, each of which is circular. When no electrical signal is passed to the third electrode 3, the area of the cavity 2 is shown in FIG. 8. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasound transducer is the first frequency. After electrical signals of opposite polarities are input to the third electrode 3 and the first electrode 1, as shown in FIG. 9, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

In a specific example, as shown in FIG. 6, the orthogonal projection of the cavity 2 on the first electrode 1 covers the orthogonal projection of the third electrode 3 on the first electrode 1, and an orthogonal projection of the cavity 2 on the first electrode 1 is circular. As shown in FIG. 10, the third electrode 3 includes three hollowed-out areas 8, and each of the hollowed-out areas 8 is circular. When no electrical signal is passed to the third electrode 3, the area of the cavity 2 is shown in FIG. 11. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency is the first frequency. After electrical signals of opposite polarities are input to the third electrode 3 and the first electrode 1, as shown in FIG. 12, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the second of the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

In a specific example, as shown in FIG. 6, the orthogonal projection of the cavity 2 on the first electrode 1 covers the orthogonal projection of the third electrode 3 on the first electrode 1, and an orthogonal projection of the cavity 2 on the first electrode 1 is circular. As shown in FIG. 13, the third electrode 3 includes two hollowed-out areas 8, and each of the hollowed-out areas 8 is circular. When no electrical signal is passed to the third electrode 3, the area of the cavity 2 is shown in FIG. 14. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasound transducer is the first frequency. After electrical signals of opposite polarities are input to the third electrode 3 and the first electrode 1, as shown in FIG. 15, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

An embodiment of the present disclosure provides a capacitive micro-machined ultrasonic transducing panel, including a plurality of the above capacitive micro-machined ultrasonic transducers that are arranged in an array. The capacitive micro-machined ultrasound transducer panel according to this embodiment supports detection in two frequency ranges, and can perform ultrasound imaging for two different body parts.

An embodiment of the present disclosure provides a capacitive micro-machined ultrasonic transducing device, including the above capacitive micro-machined ultrasonic transducing panel and a driving circuit, and the driving circuit is connected to the first electrode and the third electrode of the capacitive micro-machined ultrasonic transducer, and configured to apply electrical signals of different polarities to the first electrode and the third electrode.

An embodiment of the present disclosure provides a method for preparing a capacitive micro-machined ultrasonic transducer, including forming a first electrode, a vibrating diaphragm layer, and a second electrode that are arranged in order from bottom to top, in which a cavity exists between the first electrode and the vibrating diaphragm layer; and the method further includes forming a third electrode located on a surface of the vibrating diaphragm layer proximate to the cavity, in which an orthogonal projection of the third electrode on the first electrode covers a part of an orthogonal projection of the cavity on the first electrode.

Specifically, the method includes: forming a first electrode, a sacrificial layer, a third electrode, and a vibrating diaphragm layer in sequence on the base substrate; forming at least one via hole in the vibrating diaphragm layer, the via hole communicating with the sacrificial layer; forming a second electrode not filling the via hole on the vibrating diaphragm layer; and removing the sacrificial layer through the via hole to form a cavity in the sacrificial layer.

Among them, the orthogonal projection of the third electrode on the first electrode covers a part of the orthogonal projection of the cavity on the first electrode. After electrical signals of different polarities are applied to the first electrode and the third electrode respectively, the third electrode moves to the first electrode under the action of an electric field so that a thickness of a portion of the cavity 2 corresponding to the third electrode 3 in a direction perpendicular to the first electrode 1 is 0. Thus, the effective area of the cavity 2 can be changed, in which an orthogonal projection of the portion of the cavity 2 corresponding to the third electrode 3 on one electrode 1 coincides with an orthogonal projection of the third electrode 3 on the first electrode 1.

When there is no film layer other than the cavity 2 between the third electrode 3 and the first electrode 1, under the action of the electric field, the third electrode 3 will be in contact with the first electrode 1. When an insulating layer is further arranged on a surface of the first electrode 1 proximate to the cavity 2, under the action of the electric field, the third electrode 3 will be in contact with the insulating layer.

FIG. 8, FIG. 9, FIG. 11, FIG. 12, FIG. 14 and FIG. 15 are schematic views showing the cross section of the capacitive micro-machined ultrasonic transducer prepared according to a specific embodiment of the present disclosure. As shown in FIGS. 8, 9, 11, 12, 14, and 15, the capacitive micro-machined ultrasonic transducer prepared according to embodiment of the present disclosure includes a first electrode 1, a vibrating diaphragm layer 4 and a second electrode 7 that are arranged in order from bottom to top, a cavity 2 existing between the first electrode 1 and the vibrating diaphragm layer 4. The capacitive micro-machined ultrasonic transducer further includes a third electrode 3 located on a surface of the vibrating diaphragm layer 4 proximate to the cavity 2, in which an orthogonal projection of the third electrode 3 on the first electrode 1 covers a part of an orthogonal projection of the cavity 2 on the first electrode 1, and in which after electrical signals of different polarities are applied to the first electrode 1 and the third electrode 3, the third electrode 3 contacts the first electrode 1 and drives the vibrating diaphragm layer 4 to approach the first electrode 1 under the action of the electric field.

In this embodiment, the third electrode 3 is formed on the surface of the vibrating diaphragm layer 4 proximate to the cavity 2. When no electrical signal is passed to the third electrode 3, a cavity 2 is formed between the vibrating diaphragm layer 4 and the first electrode 1, in which the area of the cavity 2 is shown in FIGS. 8, 11, and 14. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasound transducer is the first frequency. After electrical signals of opposite polarities are input to the third electrode 3 and the first electrode 1, as shown in FIGS. 9, 12, and 15, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the plurality of sub-cavities 21 is a portion where vibration can occur, in which an orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

Among them, the area of the second portion 42 is determined by the shape and size of the third electrode 3. By changing the shape and size of the third electrode 3, the area of the second portion 42 can be changed, thereby adjusting the resonance frequency of the capacitive micro-machined ultrasound transducer.

For example, by changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 5 MHz to 10 MHz, so that the application of the ultrasound probe of the CMUT panel can be used for abdominal and cardiac examinations, as well as small organs and eye examinations. By changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 10 MHz to 30 MHz, so that the application of the ultrasound probe of the CMUT panel can be used for abdominal and cardiac examinations, as well as skin and intravascular examinations. By changing the shape and size of the third electrode 3, and then by controlling whether electrical signals are input to the third electrode 3 or not, the resonance frequency of the capacitive micro-machined ultrasonic transducer can be switched between a range from 2.5 MHz to 5 MHz and a range from 40 MHz to 100 MHz, so that the application of the ultrasound probe of the CMUT panel can be used for abdominal and cardiac examinations, as well as biological microscope imaging. By changing the shape and size of the third electrode 3, and then by controlling whether electrical signals are input to the third electrode 3 or not, the resonance frequency of the capacitive micro-machined ultrasonic transducer can be switched between a range from 10 MHz to 30 MHz and a range from 5 MHz to 10 MHz, so that the application of the ultrasound probe of the CMUT panel can be used for skin and intravascular examinations, as well as small organs and eye examinations.

By changing the shape and size of the third electrode 3, and then by controlling whether electrical signals are input to the third electrode 3 or not, the resonance frequency of the capacitive micro-machined ultrasonic transducer can be switched between a range from 40 MHz to 100 MHz and a range from 5 MHz to 10 MHz, so that the application of the ultrasound probe of the CMUT panel can be used for biological microscope imaging, as well as small organs and eye examinations. By changing the shape and size of the third electrode 3, and then by controlling whether electrical signals are input to the third electrode 3 or not, the resonance frequency of the capacitive micro-machined ultrasonic transducer can be switched between a range from 10 MHz to 30 MHz and a range from 40 MHz to 100 MHz, so that the application of the ultrasound probe of the CMUT panel can be used for skin and intravascular examinations, as well as biological microscope imaging.

Specifically, as shown in FIG. 6, the third electrode 3 is electrically connected to the electrical signal output terminal through the signal line 31, and the electrical signal can be transmitted to the third electrode 3 through the signal line 31. The preparation method further includes forming a signal line 31 connected to the third electrode 3. The signal line 31 and the third electrode 3 can be made of the same material and formed by the same patterning process.

In a specific embodiment, a method for preparing a capacitive micro-machined ultrasonic transducer includes the following steps.

Figure 16:
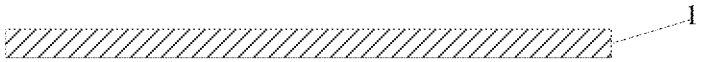
FIGS. 16 to 21 are schematic flowcharts showing the method for preparing the capacitive micro-machined ultrasonic transducer according to an embodiment of the present disclosure.

Step 1. as shown in FIG. 16, providing a base substrate, and forming a first electrode 1 on the base substrate.

Among them, the base substrate may be a quartz substrate or a glass substrate, or a silicon wafer.

Specifically, a metal layer having a thickness in a range from about 500 Å to 4000 Å can be deposited on the base substrate by sputtering or thermal evaporation, and the metal layer can be made of Cu, Al, Ag, Mo, Cr, Nd, Ni, Mn, Ti, Ta, W and other metals and alloys of these metals. One photoresist layer is coated on the metal layer, and the photoresist is exposed by using a mask to form a photoresist unreserved region and a photoresist reserved region. The photoresist reserved region corresponds to a region in which the pattern of the first electrode 1 is located, and the photoresist unreserved region corresponds to a region other than the above pattern. The development processing is performed, so that the photoresist in the photoresist unreserved region is completely removed, and the thickness of the photoresist in the photoresist reserved region remains unchanged. Then the metal layer of the photoresist unreserved region is completely etched away by an etching process, and the remaining photoresist is stripped to form a pattern of the first electrode 1.

Figure 17:
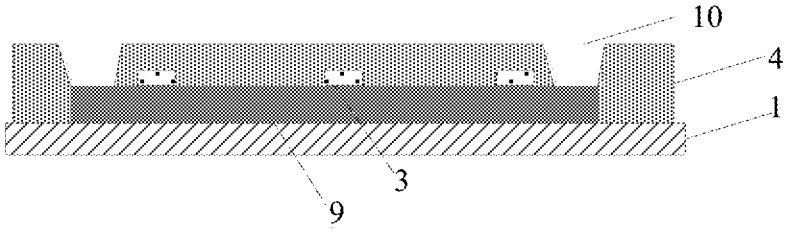

Step 2. as shown in FIG. 17, forming a sacrificial layer 9 on the first electrode 1.

Among them, the first electrode 1 is made of metal, the sacrificial layer 9 can be made of polyimide or photoresist. When the first electrode 1 is made of ITO, the sacrificial layer 9 can be made of metal, such as Mo, Al, and Cu, as long as it can ensure that the etching solution of the sacrificial layer does not cause damage to the first electrode 1.

Specifically, one layer of polyimide or photoresist may be coated on the first electrode 1 as the sacrificial layer 9, and the orthogonal projection of the sacrificial layer 9 on the base substrate is located within the orthogonal projection of the first electrode 1 on the base substrate.

Step 3. as shown in FIG. 17, forming a third electrode 3 on the sacrificial layer 9.

Specifically, a metal layer having a thickness in a range from about 500 Å to 4000 Å can be deposited on the sacrificial layer 9 by sputtering or thermal evaporation. The metal layer can be made of Cu, Al, Ag, Mo, Cr, Nd, Ni, Mn, Ti, Ta, W and other metals and alloys of these metals. One photoresist layer is coated on the metal layer, and the photoresist is exposed by using a mask to form a photoresist unreserved region and a photoresist reserved region. The photoresist reserved region corresponds to a region in which the pattern of the third electrode 3 is located, and the photoresist unreserved region corresponds to a region other than the above pattern. The development processing is performed, so that the photoresist in the photoresist unreserved region is completely removed, and the thickness of the photoresist in the photoresist reserved region remains unchanged. Then the metal layer of the photoresist unreserved region is completely etched away by an etching process, and the remaining photoresist is stripped to form a pattern of the third electrode 3.

Step 4. as shown in FIG. 17, forming a vibrating diaphragm layer 4.

Specifically, a vibrating diaphragm layer 4 having a thickness in a range from 500 Å to 5,000 Å may be deposited on base substrate of the above step 3 by a plasma enhanced chemical vapor deposition (PECVD) method. The vibrating diaphragm layer 4 may be selected from an oxide, a nitride, or an oxynitride, and the corresponding reaction gas is $SiH_4$, $NH_3$, or $N_2$; or $SiH_2Cl_2$, $NH_3$, or $N_2$. The orthogonal projection of the vibrating diaphragm layer 4 on the base substrate is located within the orthogonal projection of the first electrode 1 on the base substrate. The orthogonal projection of the sacrificial layer on the base substrate is located within the orthogonal projection of the vibrating diaphragm layer 4 on the base substrate. The vibrating diaphragm layer 4 may be dry etched, to form a via hole 10 for exposing the sacrificial layer 9. In order not to affect the integrity of the cavity 2, the via hole 10 may be located at the edge of the cavity 2.

Figure 18:
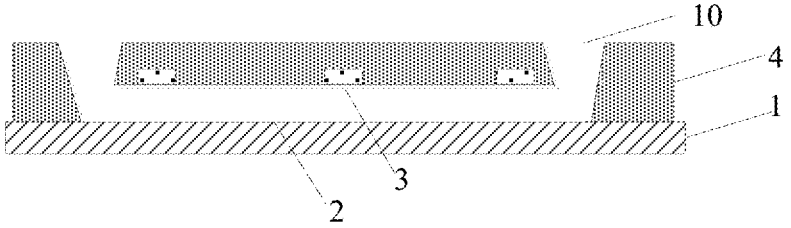

Step 5. as shown in FIG. 18, removing the sacrificial layer 9 through the via hole 10 penetrating the vibrating diaphragm layer 4.

Specifically, when the sacrificial layer 9 is made of a photosensitive material. After the sacrificial layer 9 is exposed, a developing solution may be injected into the sacrificial layer through a via hole penetrating the vibrating diaphragm layer 4. The sacrificial layer 9 is etched to remove the sacrificial layer 9, and then a cavity 2 between the vibrating diaphragm layer 2 and the first electrode 1 is formed.

Figure 19:
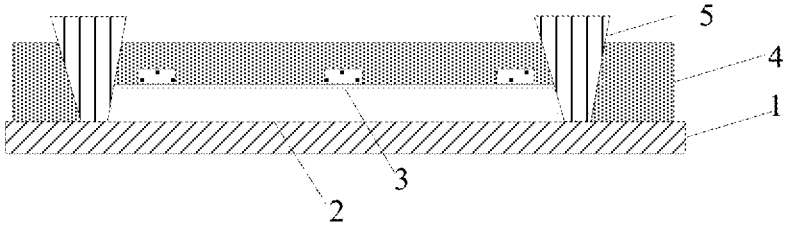

Step 6. as shown in FIG. 19, forming a filling structure 5 filling the via hole 10 of the vibrating diaphragm layer 4.

Specifically, an inorganic material such as a-Si can be deposited in the via hole of the vibrating diaphragm layer 4 to form a filling structure 5. The filling structure 5 can prevent external impurities from entering the cavity 2 and affect the operation of the capacitive micro-machined ultrasonic transducer, in which a part of the filling structure 5 fills the via hole 10 and the other part is located in the cavity 2.

Figure 20:
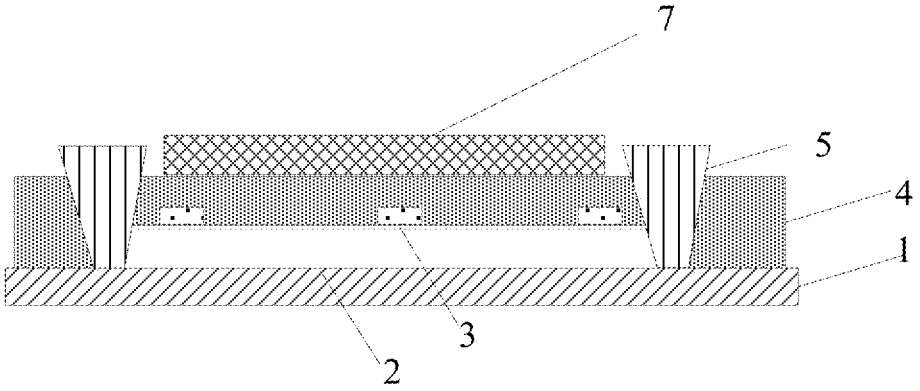

Step 7. as shown in FIG. 20, forming a second electrode 7.

Specifically, a metal layer having a thickness in a range from about 500 Å to 4000 Å can be deposited on the vibrating diaphragm layer 4 by sputtering or thermal evaporation. The metal layer can be made of Cu, Al, Ag, Mo, Cr, Nd, Ni, Mn, Ti, Ta, W and other metals and alloys of these metals. One photoresist layer is coated on the metal layer, and the photoresist is exposed by using a mask to form a photoresist unreserved region and a photoresist reserved region. The photoresist reserved region corresponds to a region in which the pattern of the second electrode 7 is located, and the photoresist unreserved region corresponds to a region other than the above pattern. The development processing is performed, so that the photoresist in the photoresist unreserved region is completely removed, and the thickness of the photoresist in the photoresist reserved region remains unchanged. Then the metal layer of the photoresist unreserved region is completely etched away by an etching process, and the remaining photoresist is stripped to form a pattern of the second electrode 7.

Figure 21:
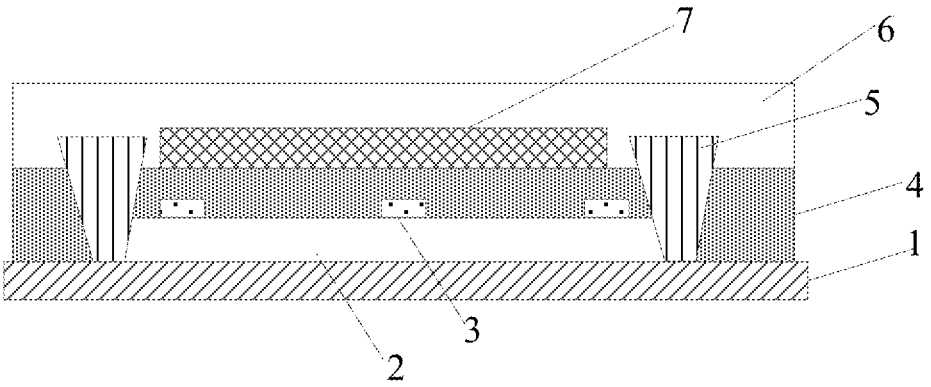

Step 8. as shown in FIG. 21, forming an insulating layer 6.

Specifically, an insulating layer 6 having a thickness in a range from 2000 Å to 1000 Å may be deposited on the base substrate after step 7 is completed by magnetron sputtering, thermal evaporation, PECVD, or other film forming methods. The insulating layer may be selected from oxide, nitride, or oxynitride compound. Specifically, the material of the insulating layer may be $SiN_x$, $SiO_x$, or $Si(ON)_x$, and $Al_2O_3$. The insulating layer may have a single layer structure or a two-layer structure composed of silicon nitride and silicon oxide. Among them, the reaction gas corresponding to the silicon oxide may be $SiH_4$ or $N_2O$; and the corresponding gas for the nitride or oxynitride may be $SiH_4$, $NH_3$, or $N_2$; or $SiH_2Cl_2$, $NH_3$, or $N_2$. The orthogonal projection of the insulating layer 6 on the base substrate is located within the orthogonal projection of the first electrode 1 on the base substrate, thereby protecting the components of the capacitive micro-machined ultrasonic transducer.

Through the above steps, the capacitive micro-machined ultrasonic transducer of this embodiment can be obtained. In the capacitive micro-machined ultrasonic transducer according to the embodiment of the present disclosure, the orthogonal projection of the cavity 2 on the first electrode 1 may have any shape of square, circle, and hexagon.

In a specific embodiment, the orthogonal projection of the cavity 2 on the first electrode 1 covers the orthogonal projection of the third electrode 3 on the first electrode 1. The orthogonal projection of the cavity 2 on the first electrode 1 is a first circle. As shown in FIGS. 7, 10 and 13, the third electrode 3 includes at least one hollowed-out area 8. The orthogonal projection of the hollowed-out area 8 on the first electrode 1 is a second circle. The diameter of the second circle is smaller than the diameter of the first circle. After the electrical signal is input to the third electrode 3, the non-hollowed-out area of the third electrode 3 contacts the first electrode 1 and drives the vibrating diaphragm layer 4 to approach the first electrode 1 under the action of the electric field, and the portion of the vibrating diaphragm layer 4 corresponding to the hollowed-out area 8 of the third electrode 3 will not be proximate to the first electrode 1, thereby forming a plurality of sub-cavities 21.

In a specific embodiment, as shown in FIG. 6, the orthogonal projection of the cavity 2 on the first electrode 1 covers the orthogonal projection of the third electrode 3 on the first electrode 1. An orthogonal projection of the cavity 2 on the first electrode 1 is circular. As shown in FIG. 7, the third electrode 3 includes two hollowed-out areas 8, and each of the hollowed-out areas 8 is circular. When no electrical signal is passed to the third electrode 3, the area of the cavity 2 is shown in FIG. 8. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasonic transducer is the first frequency. After electrical signals of opposite polarities are input to the third electrode 3 and the first electrode 1, as shown in FIG. 9, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the second of the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

In a specific embodiment, as shown in FIG. 6, the orthogonal projection of the cavity 2 on the first electrode 1 covers the orthogonal projection of the third electrode 3 on the first electrode 1, and an orthogonal projection of the cavity 2 on the first electrode 1 is circular. As shown in FIG. 10, the third electrode 3 includes three hollowed-out areas 8, and each of the hollowed-out areas 8 is circular. When no electrical signal is passed to the third electrode 3, the area of the cavity 2 is shown in FIG. 11. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasonic transducer is the first frequency. After electrical signals of opposite polarities are input to the third electrode 3 and the first electrode 1, as shown in FIG. 12, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21. The second portion 42 of the vibrating diaphragm layer 4 corresponding to the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed. The first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

In a specific embodiment, as shown in FIG. 6, the orthogonal projection of the cavity 2 on the first electrode 1 covers the orthogonal projection of the third electrode 3 on the first electrode 1, and an orthogonal projection of the cavity 2 on the first electrode 1 is circular. As shown in FIG. 13, the third electrode 3 includes two hollowed-out areas 8, and each of the hollowed-out areas 8 is circular. When no electrical signal is passed to the third electrode 3, the area of the cavity 2 is shown in FIG. 14. The first portion 41 of the vibrating diaphragm layer 4 corresponding to the cavity 2 is a portion where vibration can occur, and the orthogonal projection of the first portion 41 on the first electrode 1 coincides with the orthogonal projection of the cavity 2 on the first electrode 1. At this time, the effective area of the vibrating diaphragm layer 4 is the area of the first portion 41, and the resonant frequency of the capacitive micro-machined ultrasonic transducer is the first frequency. After electrical signals of opposite polarities are input to the third electrode 3 and the first electrode 1, as shown in FIG. 15, the third electrode 3 contacts the first electrode 1 and drives the vibrating diaphragm layer 4 proximate to the first electrode 1 under the action of the electric field, the cavity 2 is separated by the vibrating diaphragm layer 4 into a plurality of small sub-cavities 21, and the second portion 42 of the vibrating diaphragm layer 4 corresponding to the second of the plurality of sub-cavities 21 is a portion where vibration can occur. An orthogonal projection of the second portion 42 on the first electrode 1 coincides with an orthogonal projection of the plurality of sub-cavities 21 on the first electrode 1. At this time, the effective area of the vibrating diaphragm layer 4 is the area of the second portion 42, and the resonant frequency of the capacitive micro-machined ultrasonic transducer are the second frequency. It can be seen that the area of the second portion 42 is smaller than the area of the first portion 41. After the electric signal is input to the third electrode 3, the effective area of the vibrating diaphragm layer 4 is changed, so that the resonance frequency of the capacitive micro-machined ultrasound transducer is also changed, and the first frequency is different from the second frequency. In this way, by controlling whether electrical signals are input to the third electrode 3 or not, a controllable change in the resonance frequency of the capacitive micro-machined ultrasound transducer can be achieved, thereby broadens the application range of the ultrasound probe where the CMUT panel is located.

In the method embodiments of the present disclosure, the serial numbers of the steps cannot be used to define the sequence of the steps. As for one skilled in the art, the changes in the order of steps without paying creative work also fall within the scope of the present disclosure.

It should be noted that each example in the present specification are described in a progressive manner, and the same or similar parts among the various examples may be referred to each other, and each example focuses on differences from other examples. In particular, as for the examples, since they are basically similar to the product examples, the description thereof is relatively simple, and the relevant parts may be referred to description of the product examples.

Unless otherwise defined, technical terms or scientific terms used herein have the normal meaning commonly understood by one skilled in the art in the field of the present disclosure. The words "first", "second", and the like used herein does not denote any order, quantity, or importance, but rather merely serves to distinguish different components. The "including", "comprising", and the like used in the present disclosure means that the element or item appeared in front of the word encompasses the element or item and their equivalents listed after the word, and does exclude other elements or items. The word "connected" or "connecting" and the like are not limited to physical or mechanical connections, but may include electrical connections, whether direct or indirect. "On", "under", "left", "right" and the like are only used to represent relative positional relationships, and when the absolute position of the described object is changed, the relative positional relationship may also be changed, accordingly.

It will be understood that when an element, such as a layer, film, region, or substrate, is referred to as being "on" or "under" another element, the element may be directly "on" or "under" another element, or there may be an intermediate element.

In the description of the above embodiments, the specific features, structures, materials or features may be combined in any suitable manner in any one or more embodiments or examples.

The above description is merely the specific embodiment of the present disclosure, but the scope of the present disclosure is not limited thereto. Moreover, any person skilled in the art would readily conceive of modifications or substitutions within the technical scope of the present disclosure, and these modifications or substitutions shall also fall within the protection scope of the present disclosure. Therefore, the protection scope of the present disclosure should be determined by the scope of the claims.

What is claimed is:

1. A capacitive micro-machined ultrasonic transducer, comprising a first electrode, a vibrating diaphragm layer and a second electrode that are arranged in order from bottom to top, wherein a cavity exists between the first electrode and the vibrating diaphragm layer, wherein the capacitive micro-machined ultrasonic transducer further comprises a third electrode located on a surface of the vibrating diaphragm layer proximate to the cavity, and an orthogonal projection of the third electrode on the first electrode covers a part of an orthogonal projection of the cavity on the first electrode, and wherein the first electrode and the third electrode are configured such that, after electrical signals of different polarities are applied, the third electrode moves to the first electrode under the action of an electric field so that a thickness of a portion of the cavity corresponding to the third electrode in a direction perpendicular to the first electrode is 0.

2. The capacitive micro-machined ultrasound transducer of claim 1, wherein the orthogonal projection of the cavity on the first electrode covers the orthogonal projection of the third electrode on the first electrode, and the third electrode comprises at least one hollowed-out area.

3. The capacitive micro-machined ultrasonic transducer of claim 2, wherein the orthogonal projection of the cavity on the first electrode is a first circle, an orthogonal projection of the hollowed-out area on the first electrode is a second circle, and a diameter of the second circle is smaller than a diameter of the first circle.

4. The capacitive micro-machined ultrasound transducer of claim 2, wherein the third electrode comprises two, three or four hollowed-out areas.

5. The capacitive micro-machined ultrasound transducer of claim 1, further comprising a signal line connected to the third electrode.

6. The capacitive micro-machined ultrasound transducer of claim 1, wherein a lower surface of the third electrode proximate to the first electrode is substantially flush with a lower surface of the vibrating diaphragm layer proximate to the first electrode.

7. The capacitive micro-machined ultrasonic transducer of claim 1, wherein the vibrating diaphragm layer is provided with a via hole communicating with the cavity, the capacitive micro-machined ultrasonic transducer further comprises a filling structure, a part of the filling structure fills the via hole, and the other part of the filling structure is located in the cavity.

8. The capacitive micro-machined ultrasonic transducer of claim 7, wherein a diameter of the via hole is in a range from 1 μm to 10 μm.

9. The capacitive micro-machined ultrasound transducer of claim 1, wherein the vibrating diaphragm layer comprises a first portion corresponding to the cavity and a support portion other than the first portion, and an orthogonal projection of the first portion on the first electrode coincides with the orthogonal projection of the cavity on the first electrode.

10. The capacitive micro-machined ultrasound transducer of claim 1, wherein a thickness of the cavity in a direction perpendicular to the first electrode is in a range from 1 nm to 10 μm.

11. The capacitive micro-machined ultrasound transducer of claim 1, further comprises an insulating layer on a surface of the second electrode away from the first electrode.

12. The capacitive micro-machined ultrasound transducer of claim 1, wherein a material of the third electrode is same as a material of the second electrode; and/or a material of the third electrode is same as a material of the first electrode.

13. A capacitive micro-machined ultrasonic transducing panel, comprising a plurality of capacitive micro-machined ultrasonic transducers of claim 1 that are arranged in an array.

14. A capacitive micro-machined ultrasonic transducing device, comprising the capacitive micro-machined ultrasonic transducing panel of claim 13 and a driving circuit, wherein the driving circuit is connected to the first electrode and the third electrode of the capacitive micro-machined ultrasonic transducer, and configured to apply electrical signals of different polarities to the first electrode and the third electrode.

15. A method for preparing a capacitive micro-machined ultrasonic transducer, comprising forming a first electrode, a vibrating diaphragm layer, and a second electrode that are arranged in order from bottom to top, wherein a cavity exists between the first electrode and the vibrating diaphragm layer;

the method further comprises forming a third electrode located on a surface of the vibrating diaphragm layer proximate to the cavity, wherein an orthogonal projection of the third electrode on the first electrode covers a part of an orthogonal projection of the cavity on the first electrode, and the first electrode and the third electrode are configured such that, after electrical signals of different polarities are applied, the third electrode moves to the first electrode under the action of an electric field so that a thickness of a portion of the cavity corresponding to the third electrode in a direction perpendicular to the first electrode is 0.

16. The method for preparing a capacitive micro-machined ultrasonic transducer of claim 15, further comprises forming a signal line connected to the third electrode.

17. The method for preparing a capacitive micro-machined ultrasonic transducer of claim 16, wherein the signal line and the third electrode are formed by a signal patterning process.

18. The method for preparing a capacitive micro-machined ultrasonic transducer of claim 15, wherein the vibrating diaphragm layer is provided with a via hole communicating with the cavity, the method further comprises forming a filling structure, wherein a part of the filling structure fills the via hole, and the other part of the filling structure is located in the cavity.

19. The method for preparing a capacitive micro-machined ultrasonic transducer of claim 15, wherein the forming the cavity comprises:

forming a sacrificial layer on the first electrode;

forming a third electrode on the sacrificial layer;

forming a vibrating diaphragm layer covering the third electrode and the sacrificial layer, wherein the vibrating diaphragm layer has a via hole exposing the sacrificial layer; and removing the sacrificial layer through the via hole, to form the cavity between the vibrating diaphragm layer and the first electrode.

* * * * *